US005655236A

United States Patent [19]

Murray

[11] Patent Number: 5,655,236

[45] Date of Patent: Aug. 12, 1997

[54] BED SHEET HAVING INDICIA THEREON

[76] Inventor: Joan D. Murray, 5018 Warren St., Washington, D.C. 20016

[21] Appl. No.: 684,078

[22] Filed: Jul. 19, 1996

[51] Int. Cl.[6] ..... A47G 9/02

[52] U.S. Cl. ..... 5/495; 5/482; 5/907; D6/602

[58] Field of Search ..... 5/482, 495–497, 5/488, 486, 907; D6/602, 603, 617, 595, 596

[56] References Cited

U.S. PATENT DOCUMENTS

| | | | |
|---|---|---|---|
| D. 336,199 | 6/1993 | Bazata | D6/596 |
| 917,913 | 4/1909 | Van Kempen . | |
| 1,788,211 | 8/1931 | Steiner . | |
| 1,907,393 | 12/1933 | Tooley . | |
| 2,059,092 | 10/1936 | Donovan . | |
| 2,059,096 | 10/1936 | Goodchild . | |
| 3,920,012 | 11/1975 | Patel . | |
| 4,095,299 | 6/1978 | Schweiso . | |
| 4,802,250 | 2/1989 | Farr . | |
| 4,949,415 | 8/1990 | Selga | 5/482 |
| 5,095,596 | 3/1992 | Dahood . | |
| 5,208,926 | 5/1993 | Stackhouse | 5/482 |
| 5,330,230 | 7/1994 | Craig . | |
| 5,367,809 | 11/1994 | Ross . | |

FOREIGN PATENT DOCUMENTS

| | | | |
|---|---|---|---|
| 2951089 | 7/1981 | Germany | 5/482 |

*Primary Examiner*—Flemming Saether

*Attorney, Agent, or Firm*—Cushman Darby & Cushman Intellectual Property Group of Pillsbury Madison & Sutro, LLP

[57] ABSTRACT

A bed sheet of generally rectangular configuration defines a pair of opposing long edges and a pair of opposing short edges. The bed sheet includes indicia extending substantially along at least one of the edges thereof. The indicia is in the form of a repeated pattern of an alphabet letter indicating a size of the sheet. In addition, the indicia may be color coded.

11 Claims, 1 Drawing Sheet

BED SHEET HAVING INDICIA THEREON

BACKGROUND OF THE INVENTION

This invention relates to bed linens or sheets, and more particularly, to bed sheets having indicia thereon for identifying the size of the sheet.

After washing, bed sheets or linens of various sizes are typically folded and stacked together for storage until use. When it is time to use the stored sheets, it is often difficult to determine the size of the folded sheets (king, queen, double or twin). Thus, there exist a need to provide a means for identifying the different sizes of sheets which can be readily seen.

Other have attempted to identify the various sizes of sheets. For example, as disclosed in U.S. Pat. No. 1,907,393, a tab is sewn to the edge of a sheet so as to protrude from the edge. The tab carries size information such as bed type and width. The markings defining the size information on the tab is of a color different from markings of sheets of other sizes. such tabs can catch on objects with which sheets come into contact, such as parts of the washing and ironing machines. As a result, the tabs wear and may tear off the sheets. Further, since the tabs are small relative to the sheet, they are difficult to see, especially when the sheets are folded.

SUMMARY OF THE INVENTION

Accordingly, the applicant has determined that there exits a need to provide indicia for identifying the sizes of sheets which is highly visible, immediately recognizable and resistant to wear.

It is an object of the invention to provide a bed sheet having indicia to fulfill the need referred to above. In accordance with the principles of the present invention, this objective is obtained by providing a bed sheet of generally rectangular configuration defining a pair of opposing long edges and a pair of opposing short edges. The bed sheet includes indicia thereon extending substantially along at least one of the edges. The indicia includes a repeated pattern of an alphabetic letter indicating the size of the sheet. For example, if the bed sheet is a king size sheet, the repeated pattern is of the letter "K". The indicia may be sewn or printed on the edge of the sheet or may be provided on a separate fabric which is then secured to the edge of the sheet. The indicia may also include a color which indicates the size of the sheet.

Other objects, features and characteristics of the present invention as well as the methods of operation and function of the related elements of the structure, and the combination of the parts and economics of manufacture, will become more apparent upon consideration of the following detailed description and appended claims with reference to the accompanying drawings, all of which form a part of this specification.

DETAILED DESCRIPTION OF THE PRESENTLY PREFERRED EXEMPLARY EMBODIMENT

Figure 1:
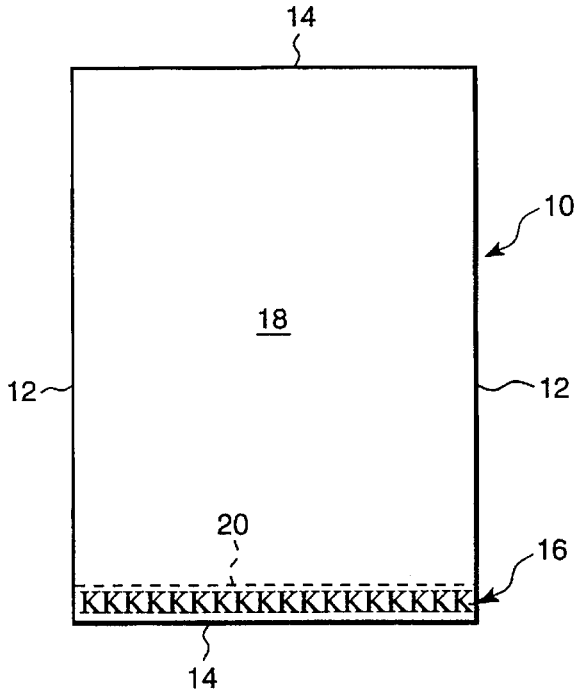
FIG. 1 is a plan view of a king size sheet with indicia thereon, embodying the principles of the present invention.

Referring to the drawings, bed sheets, generally indicated at 10, 210, 310 and 410, are shown, which embody the principles of the present invention.

With reference to FIG. 1, for example, each bed sheet 10 is of generally rectangular configuration having a pair of long edges 12 and a pair of opposing short edges 14. In accordance with the principles of the present invention, indicia, generally indicated at 16, extends along at least one edge of the sheet 10. In the illustrated embodiment, the indicia 16 is provided preferably on one of the short edges 14 of the sheet 10, since that edge may be folded under a mattress when the sheet 10 is fitted thereto. Thus, the indicia 16 will not be seen when the sheet 10 is fitted. However, it can be appreciated that if desired, the indicia 16 may be placed on any one of the edges 12 and 14, on all edges, or on a combination of long and short edges of the sheet 10.

In the illustrated embodiment, the indicia 16 is placed on one surface 18 of the sheet 10. It can be appreciated that the indicia may be provided on both surfaces of the sheet if desired.

With reference to FIG. 1, the indicia is shown extending along the short edge 14 of the sheet near hem line 20. The indicia 16 is in a form of a repeated pattern of the first alphabetical letter of a word which describes the size of the sheet. For example, in FIG. 1, a repeated pattern of the letter "K" is sewn or printed near the hem line 20 along edge 14 of the sheet to indicate that the sheet is a king size sheet.

Figure 3:
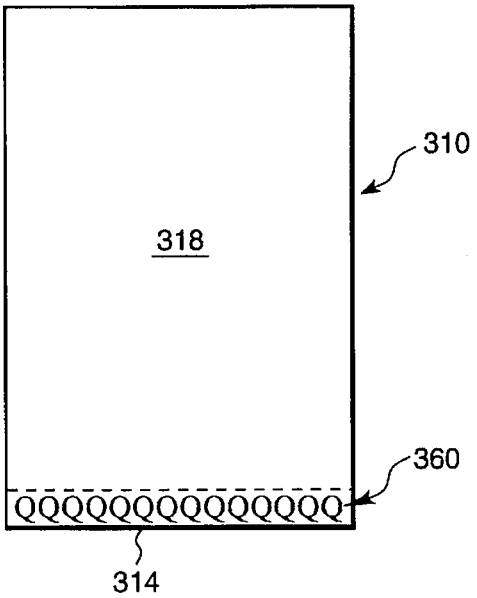
FIG. 3 is a plan view of a queen size sheet with indicia thereon, embodying the principles of the present invention.
Figure 4:
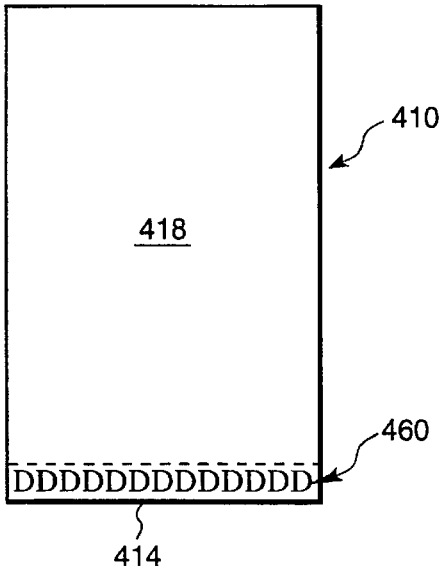
FIG. 4 is a plan view of a double size sheet with indicia thereon, embodying the principles of the present invention.

FIGS. 3 and 4 are similar to FIG. 1, but FIG. 3 shows a queen size sheet 310 wherein the indicia 360 is in the form of a repeated pattern of the letter "Q" sewn or printed along edge 314 onto the surface 318 of the sheet. FIG. 4 illustrates a double bed size sheet 410. Thus, a repeated pattern of the letter "D" is sewn or printed along edge 414 onto the surface 418 of the sheet 410.

Figure 2:
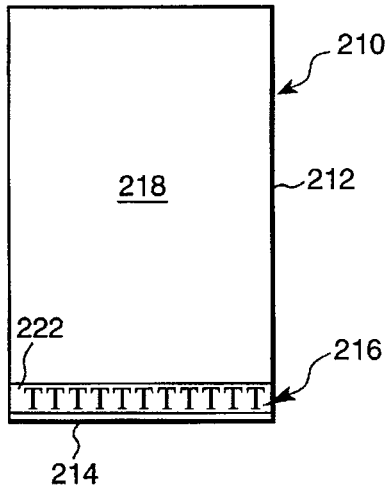
FIG. 2 is a plan view of a twin size sheet in accordance with the invention having a fabric with indicia thereon, secured to the sheet.

Although in the preferred embodiment, the indicia is sewn or printed directly on surface 18, 318 or 418, it can be appreciated that the indicia may be provided on the sheet in other ways. For example, as shown in FIG. 2, the indicia 216 which is a repeated pattern of the letter "T" indicating that the sheet 210 is a twin size sheet, is provided on an elongated piece of fabric 222. The fabric 222 with the indicia 216 thereon is then secured by sewing or by other know securing means to the edge 214 of the sheet 210. It can be appreciated that the repeated letter pattern may be a capital alphabet letter or a small alphabet letter.

In addition to the repeated pattern of letters which identifies the size of various sheets, in accordance with the invention, the indicia is color coded. For example, the letter "K" pattern on the king size sheet has a certain color and the indicia identifying each other sheet size has its own particular color.

Although, in the illustrated embodiments, the color coded indicia is in the form of a repeated alphabet letter, the indicia may be in the form of a thread of a particular color sewn to an edge of the sheet, or may be a strip of material of a particular color attached to an edge of the sheet. The color of the thread or strip of material indicates the size of the sheet.

With the indicia of the present invention, if a variety of sheets of different sizes are grouped together, one must merely locate the indicia to identify the sheet size.

It can be appreciated that the bed sheet indicia of the invention provides a highly visible means of identifying the size of various sheets. Since the indicia is either sewn or printed directly onto the sheet or provided on a separate fabric which is secured to the sheet, the indicia may not be torn and may not wear significantly during washing, or when a bed is fitted with the sheet.

While the invention has been described in connection with what is presently considered to be the most practical and preferred embodiment, it is understood that the invention is not limited to the disclosed embodiment but, on the contrary, is intended to cover various modifications and equivalent arrangements included within the spirit and scope of the appended claims.

What is claimed is:

1. A bed sheet of generally rectangular configuration defining a pair of opposing long edges and a pair of opposing short edges, said bed sheet including indicia thereon extending substantially along at least one of said edges thereof, said indicia including a repeated pattern of a single alphabet letter selected from the group consisting of the letters "K", "Q", "D" and "T" to indicate a size of the sheet.

2. The bed sheet according to claim 1, wherein said indicia is disposed on at least one of said short edges of said sheet.

3. The bed sheet according to claim 1, wherein said indicia is sewn to a surface of the sheet.

4. The bed sheet according to claim 1, wherein said indicia is printed on a surface of the sheet.

5. The bed sheet according to claim 1, wherein said indicia is provided on an elongated fabric and said fabric is secured to said at least one edge of said sheet.

6. The bed sheet according to claim 1, wherein said sheet is a king size sheet and said indicia is a repeated pattern of the letter "K".

7. The bed sheet according to claim 1, wherein said sheet is a queen size sheet and said indicia is a repeated pattern of the letter "Q".

8. The bed sheet according to claim 1, wherein said sheet is a double size sheet and said indicia is a repeated pattern of the letter "D".

9. The bed sheet according to claim 1, wherein sheet is a twin size sheet and said indicia is a repeated patter of the letter "T".

10. The bed sheet according to claim 1, wherein said indicia is disposed on one surface of said sheet.

11. The bed sheet according to claim 1, wherein said indicia is color coded to further identify a size thereof.

* * * * *